US007736214B2

(12) United States Patent
Brumagin et al.

(10) Patent No.: US 7,736,214 B2
(45) Date of Patent: Jun. 15, 2010

(54) POSABLE TOY AND METHOD OF FORMING

(75) Inventors: James G. Brumagin, Angola, NY (US); Dafna Mor, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/847,729

(22) Filed: Aug. 30, 2007

(65) Prior Publication Data

US 2008/0057827 A1 Mar. 6, 2008

Related U.S. Application Data

(60) Provisional application No. 60/824,305, filed on Sep. 1, 2006.

(51) Int. Cl.
*A63H 3/46* (2006.01)

(52) U.S. Cl. ..... 446/376; 446/375; 446/380; 446/381

(58) Field of Classification Search ..... 446/376, 446/375, 380, 381
See application file for complete search history.

(56) References Cited

U.S. PATENT DOCUMENTS

| | | | | |
|---|---|---|---|---|
| 2,152,311 | A | 3/1939 | Jacobson | |
| 2,649,806 | A * | 8/1953 | Monaghan | 446/381 |
| 3,740,894 | A | 6/1973 | Howland et al. | |
| 3,874,113 | A | 4/1975 | Beck | |
| 3,946,517 | A | 3/1976 | Goldfarb et al. | |
| 4,101,619 | A | 7/1978 | Conway et al. | |
| 4,190,982 | A * | 3/1980 | Rahmstorf | 446/384 |
| 4,571,209 | A | 2/1986 | Manning et al. | |
| 4,641,701 | A | 2/1987 | Yamamoto | |
| 4,890,356 | A | 1/1990 | Czech et al. | |
| 5,298,215 | A | 3/1994 | Krause | |
| 5,989,658 | A | 11/1999 | Miura et al. | |
| 6,261,499 | B1 | 7/2001 | Okeke et al. | |
| 6,607,684 | B1 | 8/2003 | Lee et al. | |
| 6,800,016 | B2 | 10/2004 | Wittenberg et al. | |

FOREIGN PATENT DOCUMENTS

| | | | |
|---|---|---|---|
| GB | 2191956 | A | 12/1987 |

* cited by examiner

*Primary Examiner*—Gene Kim
*Assistant Examiner*—Michael D Dennis
(74) *Attorney, Agent, or Firm*—Edell, Shapiro & Finnan, LLC

(57) ABSTRACT

A toy with repositionable portions is disclosed. The toy may be stylized as a toy figure that may include a leg section and a torso section. The leg section includes legs pivotally coupled to a pelvic section. The pelvic section may also include an upward-extending connection post. The torso section, furthermore, may include a body cylinder that connects to the connection post. The body cylinder includes a series of resilient tabs that slidingly engage the post, securing the sections together while permitting the rotation of the torso section about the post. With this configuration, the toy figure possesses multiple degrees of motion, being adapted to move in bending and twisting motions.

17 Claims, 9 Drawing Sheets

POSABLE TOY AND METHOD OF FORMING

CROSS REFERENCE TO RELATED APPLICATIONS

This application is a nonprovisional of U.S. Provisional Application No. 60/824,305, filed 1 Sep. 2006 and entitled "Posable Toy and Method of Forming", the disclosure of which is incorporated herein by reference in its entirety.

FIELD OF THE INVENTION

The present invention is directed toward a posable/repositionable toy and, in particular, to a toy figure with posable/repositionable portions adapted to be repositionable along numerous degrees of freedom, including, but not limited to, rotation about vertical and horizontal axes.

BACKGROUND OF THE INVENTION

The U.S. Government has issued "small parts" requirements for toys and products intended for use by children under three years of age. These requirements are published in the Code of Federal Regulations in Title 16, Parts 1501 and 1500.50, 51, 52 and 16 C.F.R. 1500.18(a)(9). This regulation is intended to prevent deaths and injuries to children under three from choking on, inhaling, or swallowing small objects they may "mouth". It bans toys and other articles that are intended for use by children under three and that are or have small parts, or that produce small parts when broken.

A "small part" is any object that fits completely into a specially designed test cylinder (2.25 inches long by 1.25 inches wide) that approximates the size of the fully expanded throat of a child under three years old. This specialized definition applies to (1) a whole toy or article; (2) a separate part of a toy, game, or other article; and (3) a piece of a toy or article that breaks off during testing that simulates use or abuse by children. If a "small part" fits completely into the specially designed test cylinder, and the toy or product from which it came is intended for use by children under three years of age, the toy or product is banned because the small part presents a choking hazard.

Thus, toys and products intended for use by children under three years of age must not release pieces that fit completely into the small parts cylinder after impact, flexure, torque, tension, and compression testing. These tests simulate the forces that toys and products can/may experience during normal use and abuse by children under three years of age. If these forces cause parts to break off that fit in the small parts cylinder, those parts are deemed to present a risk of choking, aspiration, or ingestion to children under three years of age.

There are a number of commercially available toys having posable/repositionable portions. Generally, these toys are stylized as character figures designed for use by preschool children. One drawback to some of these pre-existing toy figures is that the various posable/repositionable portions (e.g., the legs, the arms, the head, the torso, etc.) are made of small parts that are connected in such manner that they are capable of being too easily separated. Due to safety concerns, there has been increased awareness regarding the safety of such toy figures (due to the fact that preschool children may be able separate the portions of the figure, which may result in injury to the child should one of the portions be swallowed). Thus, it is desirable to provide a toy, having posable/repositionable portions, with a generally integral structure that prevents the posable/repositionable portions from being too easily separated.

SUMMARY OF THE INVENTION

The present invention generally is directed toward a posable/repositionable toy and, in particular, to a toy figure with posable/repositionable portions adapted to be repositionable along numerous degrees of freedom, including, but not limited to, rotation about vertical and horizontal axes. A toy figure in accordance with the present invention may include a lower or first assembly and an upper or second assembly. The lower assembly may include legs pivotally coupled to a pelvic section. The pelvic section may include an upward-extending connection post. The upper assembly may include a spine and body cylinder, both of which may be rotatably mounted on the upward-extending connection post. An external figure body may be secured to the spine and body cylinder. Thus, the external figure body, the spine, and the body cylinder may be rotated with respect to the lower assembly. With this configuration, a toy figure in accordance with the present invention possesses multiple degrees of freedom, being adapted to move in bending and twisting motions.

BRIEF DESCRIPTION OF THE DRAWINGS

Like reference numerals have been used to identify like elements throughout this disclosure.

DETAILED DESCRIPTION OF THE INVENTION

Figure 1:
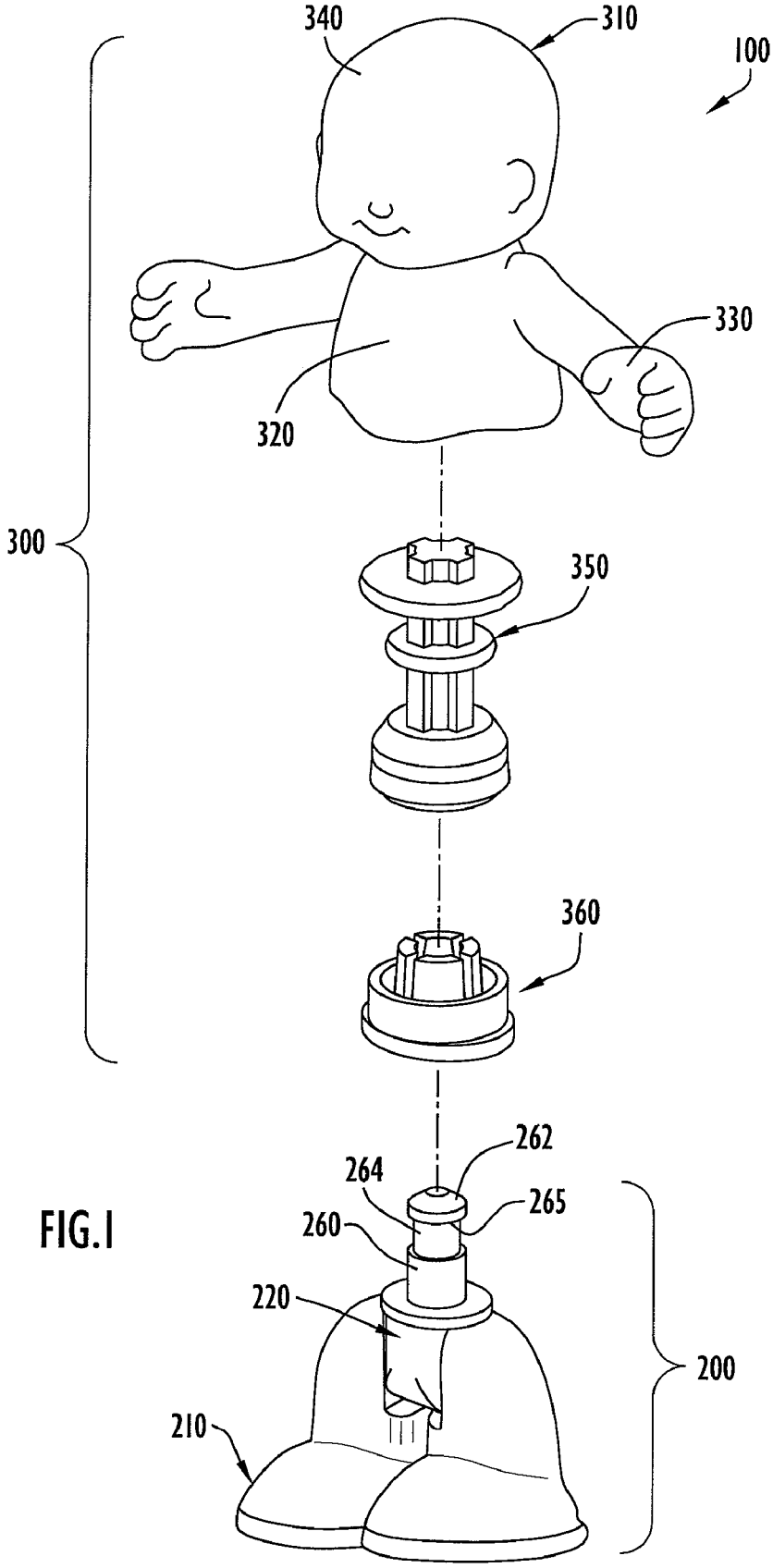
FIG. 1 illustrates an exploded view of a posable toy according to an embodiment of the present invention.

In accordance with the present invention, a toy with posable/repositionable portions is disclosed. FIG. 1 is an exploded view of a posable/repositionable toy in accordance with an embodiment of the present invention. As shown, the posable/repositionable toy may comprise a FIG. 100 including a first or lower assembly 200 and a second or upper assembly 300. The components of the lower assembly 200 and upper assembly 300 may be formed from materials including, but not limited to, plastics/thermoplastics such as acrylonitrile butadiene styrene (ABS) and/or polyvinyl chloride (PVC), as well as natural materials such as wood. In one embodiment of the present invention described herein, the lower assembly 200 and the upper assembly 300 are formed utilizing a combination of ABS and PVC components. The components may be formed utilizing, e.g., conventional molding processes such as blow molding, injection molding, insert molding, over-molding, etc.

The lower assembly 200 may include a support or leg section 210 and a base or pelvic section 220. The base section 220 may include a bore or channel (extending, e.g., generally horizontally through the pelvic section 220), as well as a connection post 260 extending, e.g., generally vertically from the base section 220. The connection post 260 is configured to mate with the upper assembly 300. In the illustrated embodiment, the upper (distal) end of the connection post 260 includes a flange or rim 262 and a recessed portion 264 extending about its periphery. The recessed portion 264, in combination with the rim 262, forms a shoulder or ledge 265 that serves as a stop, preventing the separation of the upper assembly 300 from the lower assembly 200. With this configuration, the post 260 may rotatably capture the body cylinder 360 of the upper assembly 300 when mounted onto to the connection post 260 (described in greater detail below).

Figure 2A:
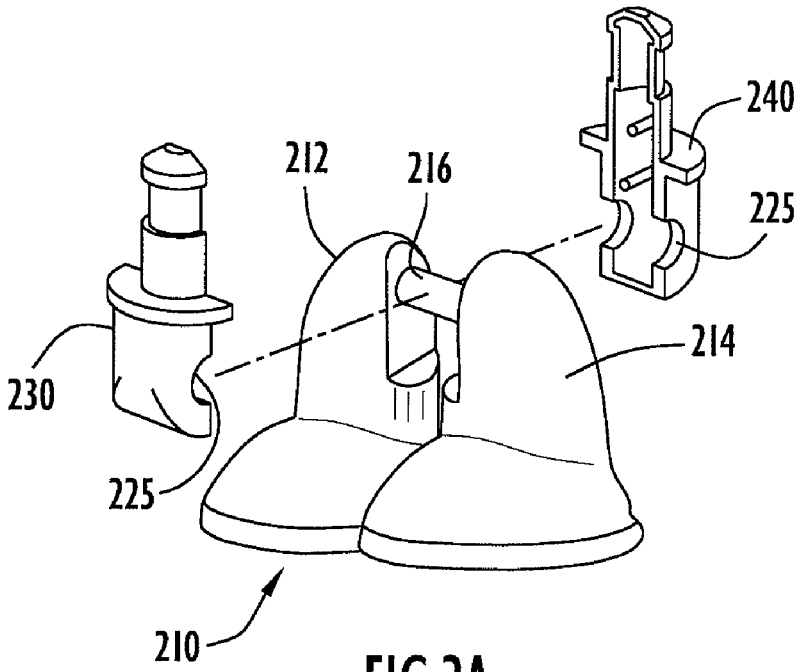
FIG. 2A illustrates an isolated, exploded view of the lower assembly of the posable toy of FIG. 1.
Figure 2B:
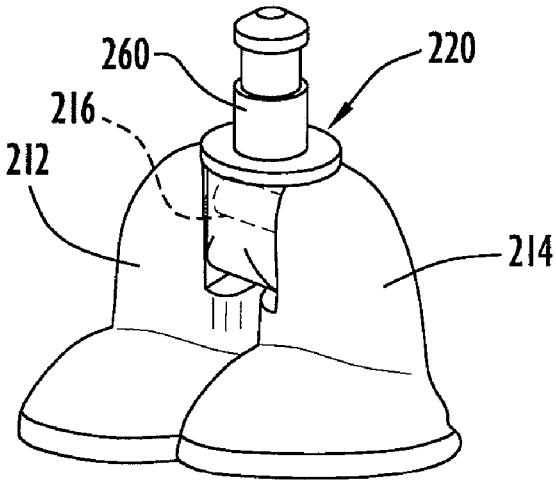
FIG. 2B illustrates an isolated, perspective view of the lower assembly of the posable toy of FIG. 1.

FIG. 2A is an exploded view of the lower assembly of the posable/repositionable toy of FIG. 1. Referring to FIG. 2A, the leg section 210 of the lower assembly 200 may include a first leg member 212 coupled to a second leg member 214 via a rod 216. The base section 220 may include a front waist portion 230 and a rear waist portion 240. The front 230 and rear 240 waist portions may each include a cut-out area 225 that form a bore or channel when the waist portions 230, 240 are connected. To form the lower assembly 200, the cut-out areas 225 of the waist portions 230, 240 are aligned such that the rod 216 of the leg section 210 is positioned within the cut-out areas 225. FIG. 2B is an isolated view of the lower assembly of the posable/repositionable toy of FIG. 1. As shown in FIG. 2B, the waist portions 230, 240 may be permanently secured to each other (e.g., via solvent welding) by capturing the rod 216 of the leg section 210 in the newly-formed bore 250.

Utilizing this construction, the rod 216 of the leg section 210 may be configured to move within the bore formed by the connected portions 230, 240 with the base section 220 pivoting about the rod 216. The connection of the leg section 210 to the base section 220 is not limited to the embodiment illustrated herein. For example, in another embodiment, the base section 220 may be formed from a unitary structure (e.g., the base section 220 may be over-molded onto the leg section 210 (not illustrated)). Although any suitable materials may be utilized, in the illustrated embodiment, the base section 220 (including waist portions 230, 240) may be formed from ABS, while the leg section 210 may be formed from PVC.

Figure 3A:
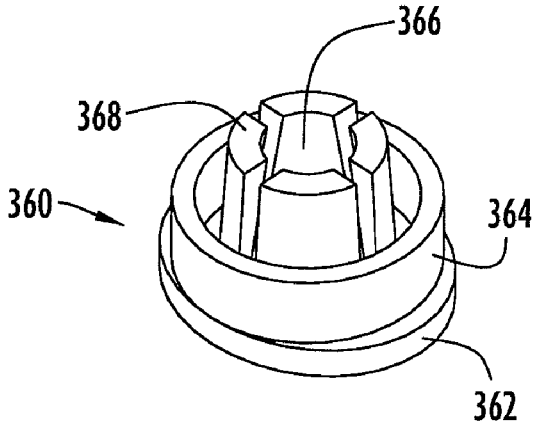
FIG. 3A illustrates an isolated, perspective view of the body cylinder shown FIG. 1.

Referring back to FIG. 1, the upper assembly 300 may include a figure upper body 310 including a torso 320, arms 330, and a head 340. The upper assembly 300 may further include a core member or spine 350 and a body cylinder or cap 360 (also called a plug). The body cylinder 360 may include a structure configured to rotatably connect to the connection post 260 of the lower assembly 200, securing the spine 350 of the upper assembly 300 to the lower assembly 200. FIG. 3A is an isolated perspective view of the body cylinder 360. In the embodiment illustrated, the body cylinder 360 includes a base 362 with a wall or flange 364 extending upward about the periphery of the base 362. A channel or bore 366, concentrically disposed with respect to the flange 364, may be defined by a series of angularly spaced, resilient tabs 368.

Figure 3B:
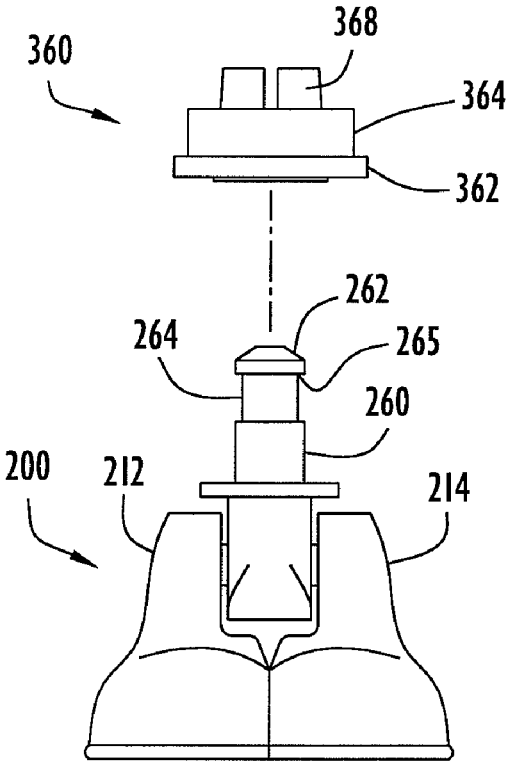
FIGS. 3B and 3C illustrate isolated views of the lower assembly, showing the connection of the body cylinder to the lower assembly.
Figure 3C:
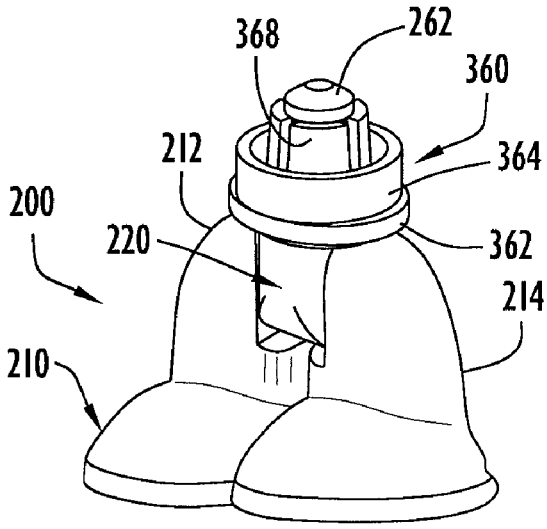

The dimensions of the channel 366 may be chosen such that the tabs 368 slidingly, yet securely engage the connection post 260 of the lower assembly 200. Referring to FIGS. 3B and 3C, the channel 366 of the body cylinder 360 receives the post 260 of the lower assembly 200. Specifically, the connection post 260 of the lower assembly 200 may be axially urged into the channel 366 of the cylinder body 360. The resilient tabs 368, beginning in their normal position, initially flex outward to permit passage of the connection post 260 and/or rim 262. However, once the tabs 368 become positioned below the rim 262 and within the recessed portion 264, the tabs 368 return to their normal (un-flexed) position. In this position, the passage of the rim 262 back through the channel 366 is prevented—the rim 262 cannot pass back through the channel 366 without a very large force being applied to the two parts (i.e., a force larger than a child is capable of exerting during play or product abuse). When the tabs 368 return to their normal, un-flexed position, the shoulder 265 acts as a stop, preventing the passing of the post 260 through the channel 366. This attachment arrangement prevents the removal of the body cylinder 360 from the connection post 260. However, since the resilient tabs 368 slidingly engage the post 260, the body cylinder 360 may be rotated about the post 260.

Figure 4A:
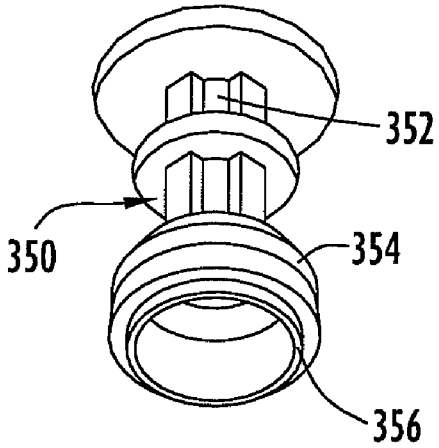
FIG. 4A illustrates an isolated, perspective view of the spine shown in FIG. 1.
Figure 4B:
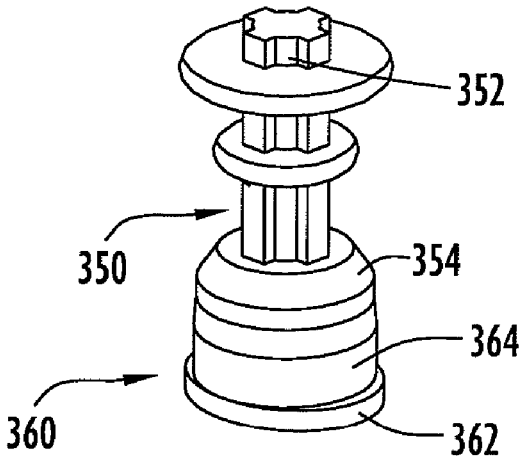
FIG. 4B illustrates the body cylinder of FIG. 3A coupled to the spine of FIG. 4A.

The spine 350 supports the figure body. As seen best in FIG. 4A, the spine 350 may include a cylindrical shaft 352 terminating in a socket 354 operable to mate with the body cylinder 360. The socket includes a lip 356 extending about the perimeter of the socket opening. In operation (as illustrated in FIG. 4B), the spine 350 may be inserted axially onto the body cylinder 360 until the socket 354 of the spine 350 engages the flange 364 of the body cylinder 360. The lip 356 becomes positioned between the gap existing between the wall 364 and the tabs 368 of the body cylinder 360 (see FIG. 3A). In this manner, when the socket 354 is seated on the cylinder 360, the lip 356 may further compress the resilient tabs toward the connection post, which, in turn, makes separation of the lower assembly 200 from the upper assembly 300 more difficult. The body cylinder 360 may be permanently secured to the spine 350 using techniques such as solvent welding. The combined (connected) spine/cylinder structure is illustrated in FIG. 4B.

Figure 4C:
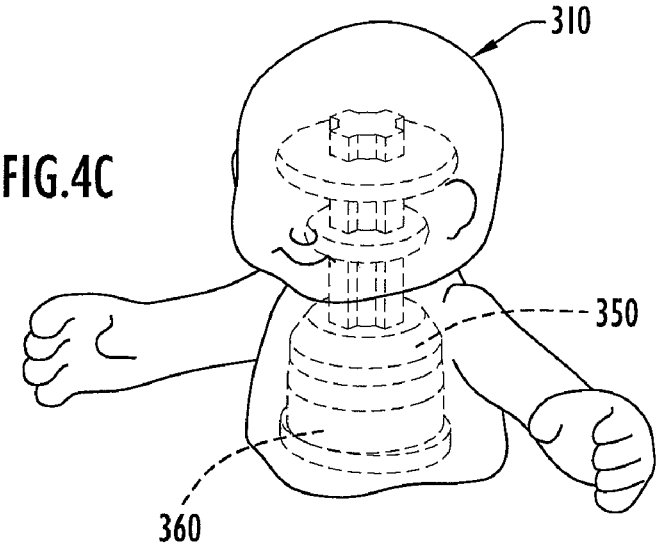
FIG. 4C illustrates an isolated view of the upper assembly shown in FIG. 1, with the spine/body cylinder illustrated in phantom.

Referring to FIG. 4C, the figure body 310 is secured to the combined spine/cylinder structure (e.g., it may be formed over the spine 350 via molding). Since the body cylinder 360 rotatably engages the connection post 260, the spine 350, fixed to the figure body 310, may also rotate about the axis defined by the connection post 260. Although any suitable materials may be utilized, in the illustrated embodiment, the spine 350 (including the cylindrical shaft 352 and the socket 354) and the body cylinder 360 (including the base 362, the flange 364, and the tabs 368) may be formed from ABS, while the figure body 310 (including the torso 320, the arms 330, and the head 340) may be formed from PVC.

Figure 5:
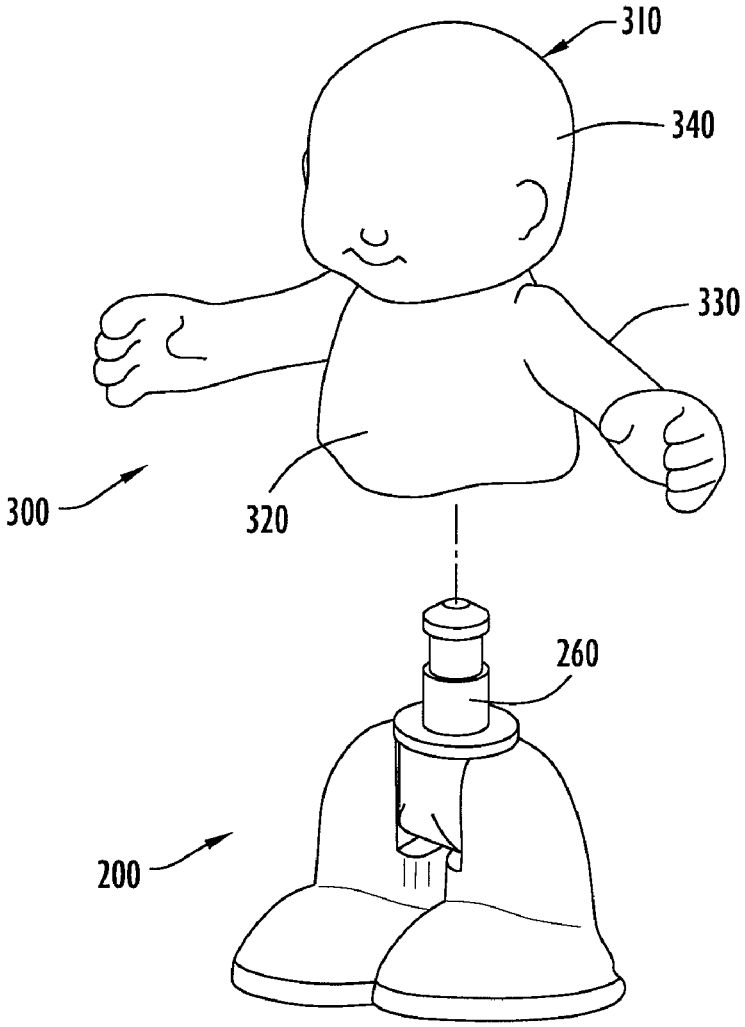
FIG. 5 illustrates an exploded view of the upper and lower assemblies of the posable/repositionable toy of FIG. 1, showing the connection of the upper assembly to the lower assembly.

The method of forming the posable/repositionable toy 100 is explained with reference to FIGS. 2-5. Initially, as shown in FIGS. 2A and 2B, the leg section 210 may be coupled to the base section 220 as described above. Then, the spine 350 may be coupled to the body cylinder 360 as described above (FIG. 4B), and the figure body 310 may then be over-molded onto the combined spine/cylinder 350/360 structure, fixing the figure body 310 thereto (FIG. 4C). Finally, as shown in FIG. 5, the upper assembly 300 may be coupled to the lower assembly 200. As explained above, the body cylinder 360 of the upper assembly 300 mates with the post 260 of the lower assembly 200, with the tabs 368 engaging the post 260 as described above. This provides a substantially permanent connection between the upper assembly 300 and the lower assembly 200, while enabling the movement (for example, rotation) of the upper assembly with respect to the lower assembly (and vice versa).

Figure 6:
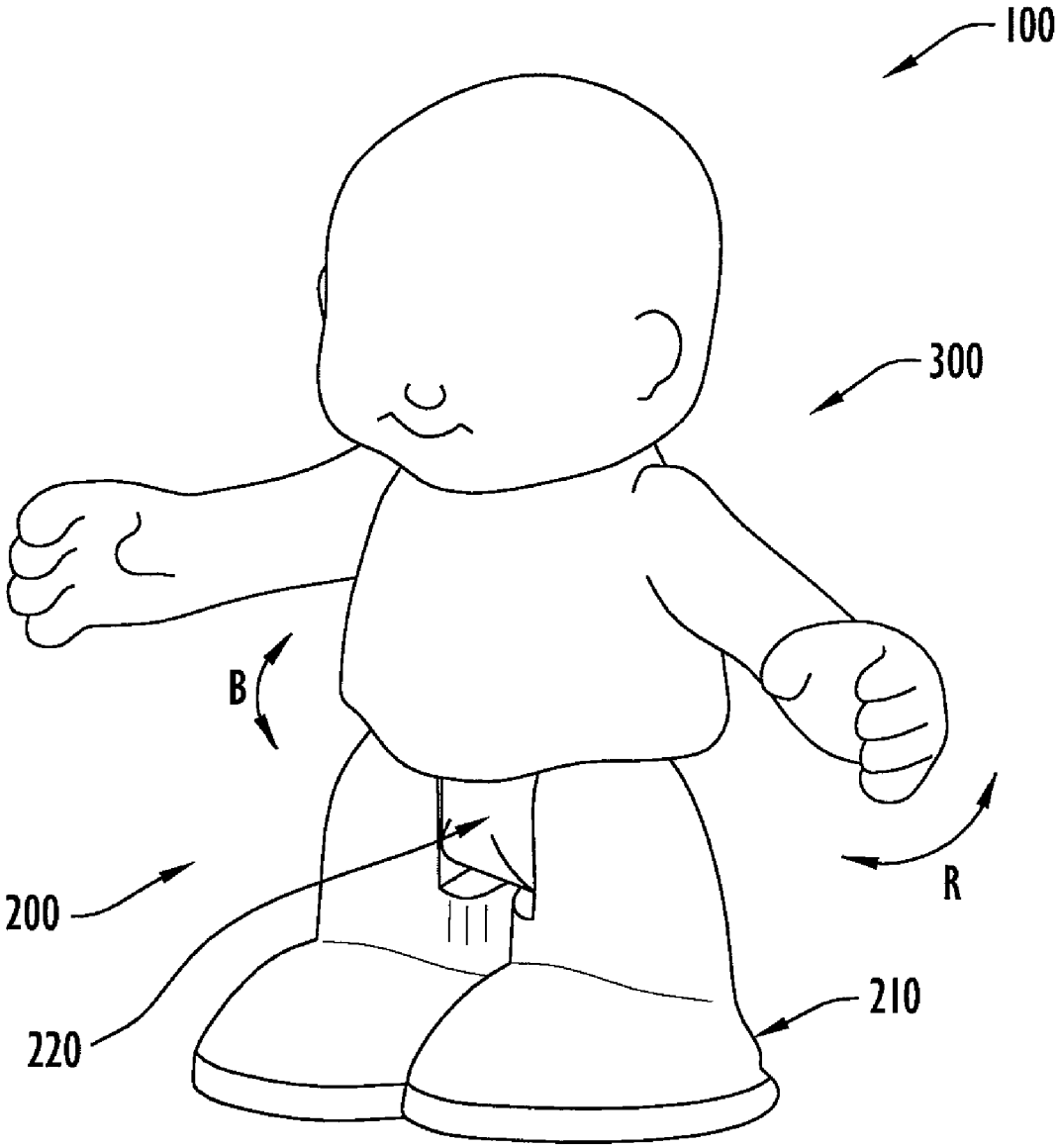
FIG. 6 illustrates a perspective view of the assembled posable/repositionable toy of FIG. 1.

In this manner, the present invention allows for the production of a posable/repositionable toy 100 without the use of conventional fasteners (screws, bolts, rivets, etc., all of which may be categorized as "small parts" for a product designed for children under three years of age), while providing a toy 100 that may be posed/repositioned along plural degrees of freedom. Referring to FIG. 6, the leg section 210 is adapted to rotate about the base section 220 (e.g., about a horizontal axis) to create a bending motion of the toy 100 (indicated by arrow B). Additionally, as indicated by arrow R, the figure body 310 (and the entire upper assembly 300) is adapted to rotate with respect to the entire lower assembly 200 (e.g., about a generally vertical axis) to create a twisting motion of the toy 100.

Figure 7:
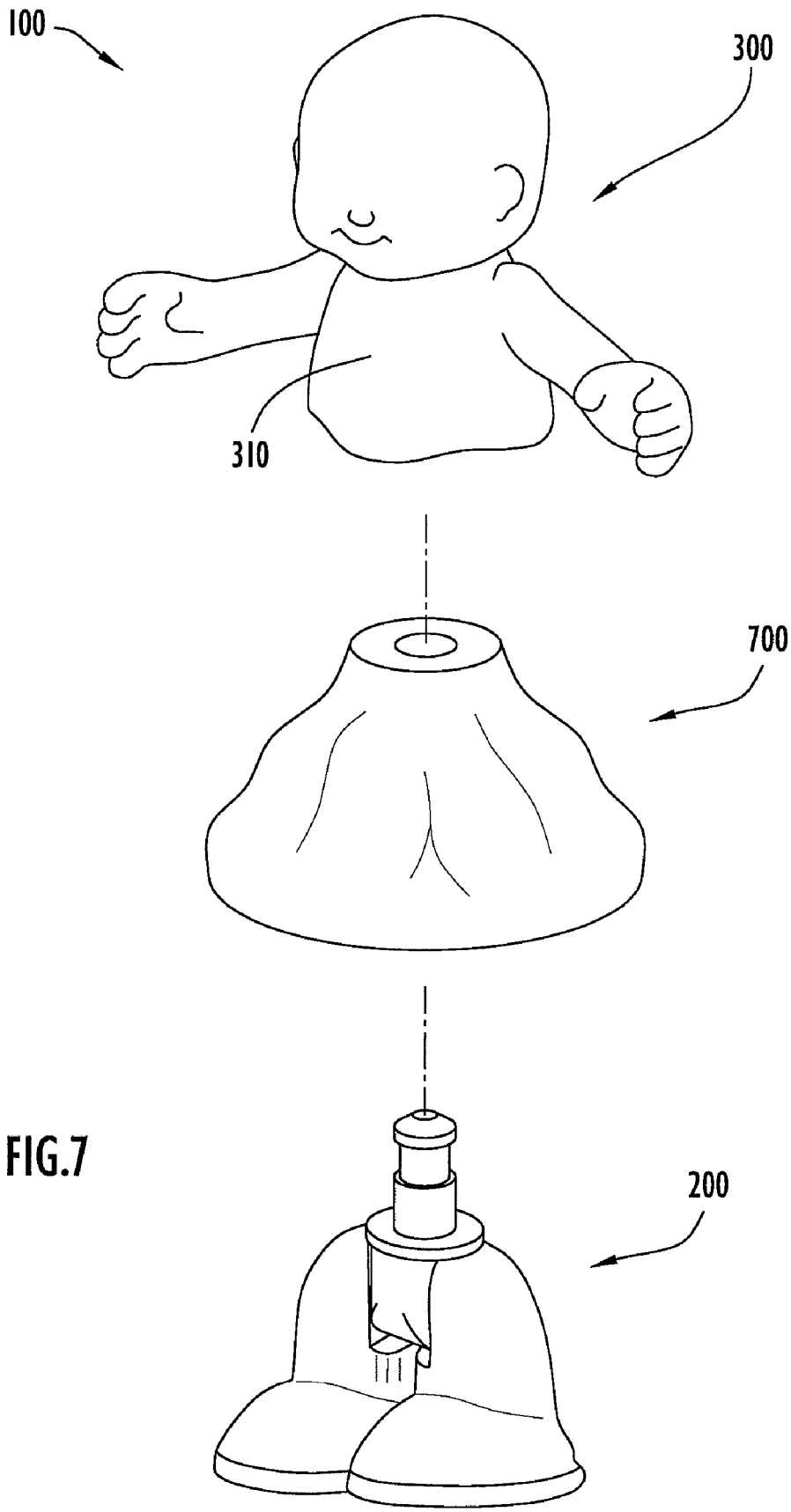
FIG. 7 illustrates an exploded view of a posable/repositionable toy according to another embodiment of the present invention.

An accessory item may also be positioned onto the lower assembly 200 such that it becomes captured between the lower assembly 200 and the upper assembly 300. FIGS. 7-9 illustrate a posable toy 100 in accordance with another embodiment of the present invention. Referring to FIG. 7, the posable toy 100 includes a general structure similar to that described above with reference to FIGS. 1-6, having a lower assembly 200 and an upper assembly 300 overmolded with a figure body 310. In addition, the posable toy 100 further includes an accessory 700 in the form of an article of clothing. The article of clothing may include any decorative or functional accessory including, but not limited to, dresses, pants, shorts, belts, skirts, weapons, bags, etc. The accessory may be formed from materials including, but not limited to, soft-goods (e.g., cloth), plastic, wood, etc.

Figure 8A:
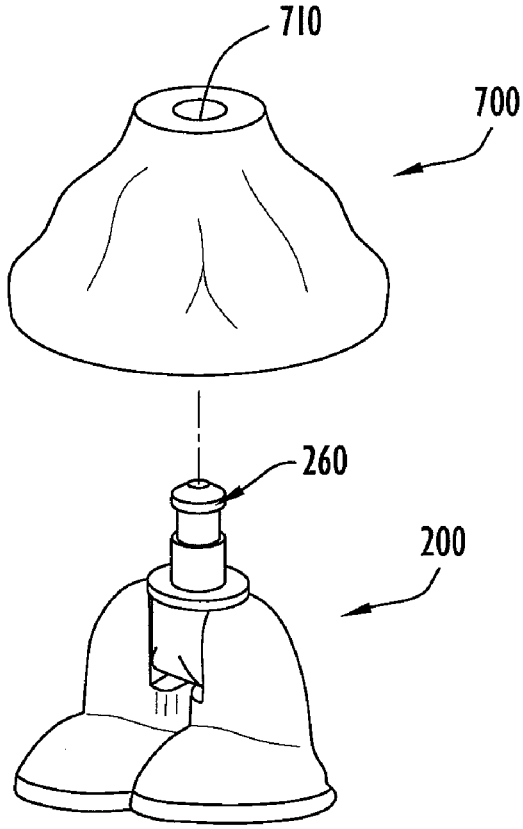
FIGS. 8A and 8B illustrate front perspective views of the lower assembly of the posable/repositionable toy of FIG. 7, showing the connection of an accessory article of clothing to the lower assembly.
Figure 8B:
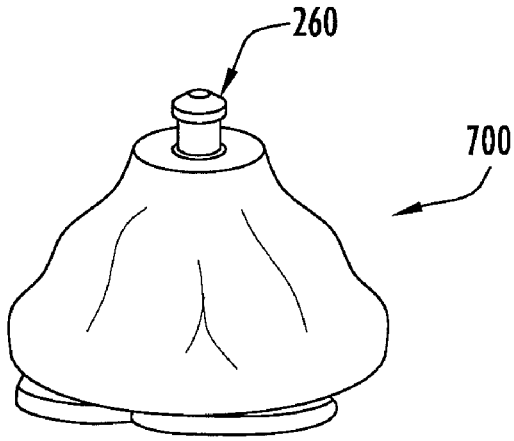
Figure 9:
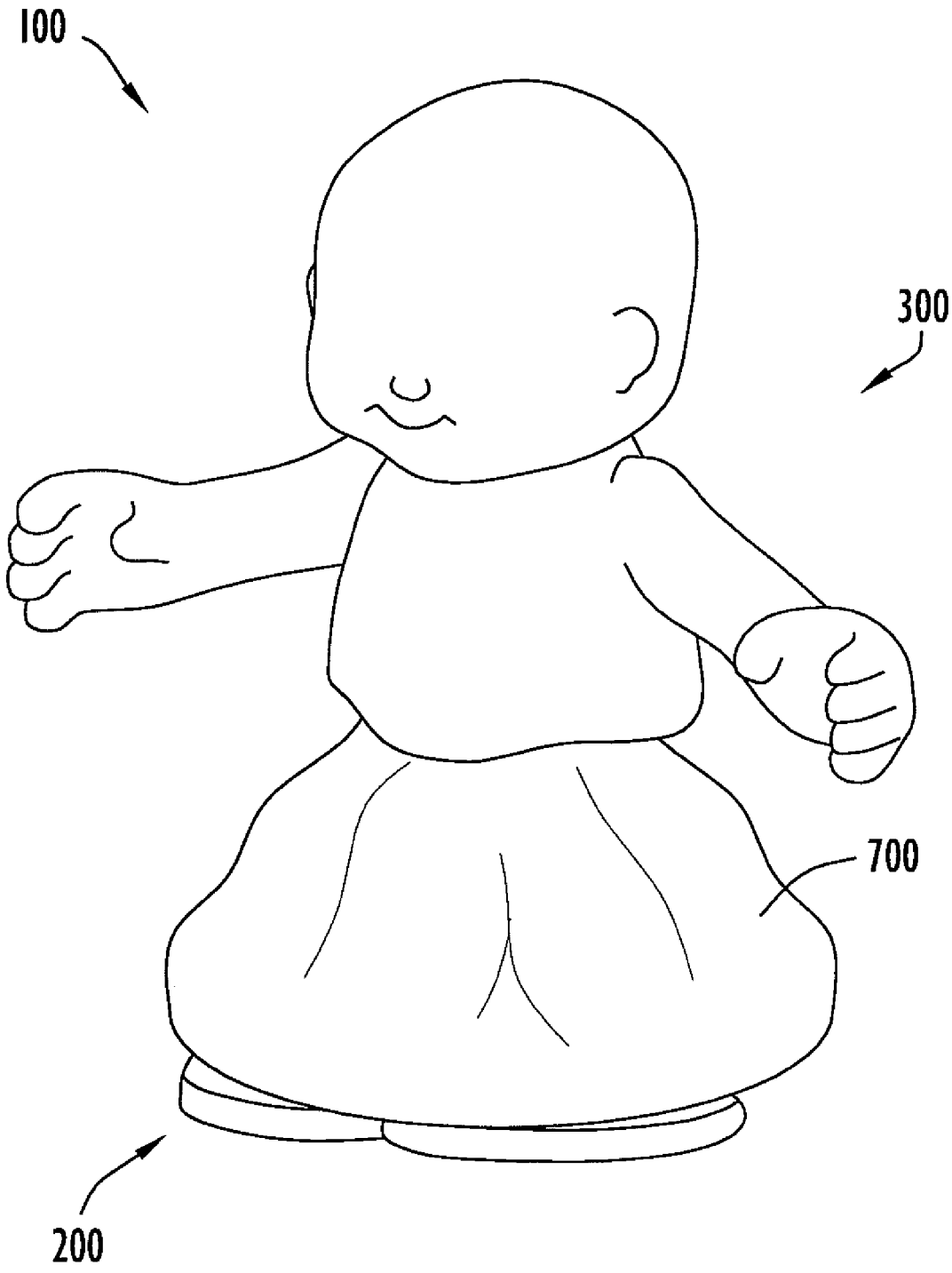
FIG. 9 illustrates a front perspective view of the posable/repositionable toy of FIG. 7, showing the assembled figure and the capturing of the accessory article of clothing between the upper and lower assemblies.

Referring to FIGS. 8A and 8B, it can be seen the accessory 700 may include an aperture 710 with dimensions slightly larger than the dimensions (e.g., diameter) of the of the connection post 260. The connection post 260 is inserted through the aperture, positioning the accessory 700 onto the lower assembly 200 as illustrated in FIG. 8B. The upper assembly 300 may then be secured to the connection post 260 as described above, with the body cylinder 360 pressing the accessory 700 against the lower assembly 200. In this manner the accessory 700 is non-removably trapped between the upper assembly 300 and the lower assembly 200, securing it to the toy 100 (FIG. 9).

While the invention has been described in detail and with reference to specific embodiments thereof, it will be apparent to one skilled in the art that various changes and modifications can be made therein without departing from the spirit and scope thereof. For example, the posable/repositionable toy can be of any size and shape, and may be formed from any suitable materials. Though the connection structure has been illustrated with regard to waist/torso and leg/torso components, the structure may be easily adapted for other articulated portions such as head/torso, arm/torso, etc. In addition, the disclosed connection mechanism/method may be applied to other toy products (e.g., vehicles, animals, buildings, play sets etc.). Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A connection assembly for a toy with repositionable portions, the connection assembly comprising:
- a leg assembly including:
  - a platform,
  - a post extending distally from the platform, wherein the post comprises:
    - a post proximal end and a post distal end,
    - a rim disposed at the post distal end;
- a plug coupled to the leg assembly, the plug comprising:
  - a base,
  - a plurality of resilient tabs extending from the base, and
  - a channel extending through the plug, wherein the tabs are oriented in angularly spaced relation about the channel, the channel being operable to receive the post; and
- a core member comprising a shaft having an proximal end and a distal end,
- wherein the plug is mounted onto the post, and wherein the core member is coupled to the plug such that the core member captures the resilient tabs against the post.

2. The connection assembly of claim 1, wherein the plug is rotatably coupled to the leg assembly.

3. The connection assembly of claim 1, wherein the core member further comprises a socket disposed at the proximal end of the shaft, the socket operable to receive the tabs of the plug.

4. The connection assembly of claim 3, wherein:
- the plug further comprises a flange extending distally about a perimeter of the base, the flange being generally coaxial with respect to the tabs to form a gap between the flange and the tabs;
- the socket comprises a lip extending distally from the socket; and
- the lip is inserted into the gap such that the lip engages the tabs, compressing the tabs against the post.

5. The connection assembly of claim 3, wherein the core member further comprises a toy figure overmolded onto the shaft.

6. The connection assembly of claim 1, wherein:
- the post of the leg assembly further comprises a recessed area to define a shoulder along the rim of the post; and
- the resilient tabs are positioned within the recessed area to inhibit the separation of the plug from the post.

7. The connection assembly of claim 1, wherein the leg assembly further comprises a leg section including:
- a first leg member;
- a second leg member; and
- a rod connecting the first leg member to the second leg member.

8. The connection assembly of claim 7, wherein the leg section is rotatably is rotatably coupled to the post.

9. A posable toy figure comprising:
- a first figure portion including:
  - a base section,
  - a leg section coupled to the base section, and
  - a connection post extending from the base section; and
- a second figure portion comprising:
  - a torso,
  - a spine assembly disposed within the torso, the spine assembly including:
    - a cap member having a plurality of resilient tabs defining a channel that receives the connection post of the first figure portion, and a shaft having a proximal end and a distal end, the proximal end of the shaft including a socket operable to capture the resilient tabs against the connection post to prevent the separation of the spine assembly from the connection post.

10. The posable toy figure of claim 9, wherein the resilient tabs rotatably couple the first figure portion to the second figure portion.

11. The posable toy figure of claim 9, wherein the leg section comprises:

a first leg member, a second leg member, and a rod connecting the first leg member to the second leg member; and a bore formed within base section, wherein the rod is disposed within the bore such that the base section rotates with respect to the leg section.

12. The posable toy figure of claim 9, wherein:

the connection post further comprises a recessed area; and the resilient tabs are positioned within the recessed area to inhibit the separation of the first figure portion from the second figure portion.

13. The posable toy figure of claim 9, wherein the socket comprises a lip that urges the tabs into contact with the post.

14. A method of forming a posable/repositionable toy figure comprising:

(a) forming a first toy portion comprising a connection post;

(b) forming a second toy portion comprising:

a cap including a plurality of resilient tabs defining a channel that receives the connection post of the first portion, and a core member operable to capture the resilient tabs against the connection post; and (c) coupling the first toy portion to the second toy portion by inserting the connection post into the channel of the cap, wherein the core member engages the plurality of resilient tabs to capture the tabs against the post, securing the first toy portion to the second toy portion, wherein the cap is configured to rotate about the connection post.

15. The method of claim 14, wherein the connection post further comprises a recessed area, and wherein step (c) further comprises positioning the plurality of resilient tabs within the recessed area of the connection post.

16. The connection assembly of claim 1, wherein:

the post comprises a generally vertical post;

the plug comprises a generally vertical outer wall extending from a surface of the base about a periphery of the base;

the tabs are concentrically disposed in spaced relation from the outer wall to form a gap between the tabs and the outer wall; and the core member comprises:

an open receptacle disposed along the proximal end of the shaft, and a lip extending from the receptacle, wherein the lip is positioned within the gap and is configured to compress the tabs against the vertical post.

17. The connection assembly of claim 1, wherein the plug mounts onto the post such that the plug base rests on the platform of the leg assembly.

* * * * *